US011738228B1

(12) United States Patent
Stearns

(10) Patent No.: US 11,738,228 B1
(45) Date of Patent: Aug. 29, 2023

(54) EXERCISE ASSIST APPARATUS

(71) Applicant: Kenneth W Stearns, Houston, TX (US)

(72) Inventor: Kenneth W Stearns, Houston, TX (US)

( * ) Notice: Subject to any disclaimer, the term of this patent is extended or adjusted under 35 U.S.C. 154(b) by 0 days.

(21) Appl. No.: 17/209,036

(22) Filed: Mar. 22, 2021

Related U.S. Application Data

(60) Provisional application No. 62/992,957, filed on Mar. 21, 2020.

(51) Int. Cl.
*A63B 21/00* (2006.01)
*A63B 21/068* (2006.01)

(52) U.S. Cl.
CPC ..... *A63B 21/00181* (2013.01); *A63B 21/068* (2013.01); *A63B 21/155* (2013.01); *A63B 21/156* (2013.01)

(58) Field of Classification Search
CPC ..... A63B 21/00181; A63B 21/068; A63B 21/00058–00065; A63B 21/02; A63B 21/04–0407; A63B 21/0428; A63B 21/0435; A63B 21/055–0557; A63B 21/15; A63B 21/151; A63B 21/154; A63B 21/155; A63B 21/156
See application file for complete search history.

(56) References Cited

U.S. PATENT DOCUMENTS

| | | | | | |
|---|---|---|---|---|---|
| 2,673,737 | A * | 3/1954 | Daniels | A63B 23/0233 | 482/130 |
| 5,601,518 | A * | 2/1997 | Weintraub | A63B 21/0552 | 482/904 |
| 5,820,529 | A * | 10/1998 | Weintraub | A63B 21/0552 | 482/904 |
| 7,569,005 | B2 * | 8/2009 | Geeting | A63B 21/0004 | 482/121 |
| 7,771,329 | B2 * | 8/2010 | Dalebout | A63B 21/0628 | 482/99 |
| 8,388,504 | B2 * | 3/2013 | Ellis | A63B 21/0616 | 482/100 |
| 10,486,010 | B1 * | 11/2019 | Leipheimer | A63B 21/4043 | |

* cited by examiner

*Primary Examiner* — Garrett K Atkinson
*Assistant Examiner* — Kathleen M Fisk
(74) *Attorney, Agent, or Firm* — Nick A Nichols, Jr.

(57) ABSTRACT

An exercise assist apparatus may include a frame and a cam assembly pivotally connected to the frame. A cable having one end fixedly secured to the frame may extend over a traveling pulley operably connected to the cam assembly and about a fixed pulley connected to the frame. One or more flexible progressive resistance bands may provide substantially linear assistance/resistance throughout an exercise.

14 Claims, 3 Drawing Sheets

EXERCISE ASSIST APPARATUS

CROSS-REFERENCE TO RELATED APPLICATION

This application claims priority to and the benefit of the filing date of U.S. Provisional Application Ser. No. 62/992,957, filed Mar. 21, 2020, which application is herein incorporated by reference in its entirety.

BACKGROUND

The present invention relates to exercise apparatus, more particularly to an exercise assist apparatus providing substantially linear assistance/resistance throughout an exercise motion.

Pull-up, chin-up and dip exercises require an exerciser to move his/her body weight against the force of gravity. Weight assist exercise machines provide resistance or assistance that is constant throughout the motion of the exercise. These types of exercise machines may typically be found in gyms and may be relatively complex and expensive exercise equipment. Exercise resistance bands may also be used to provide exercise assistance and have gained in popularity in recent years. The bands are relatively cheap and may be used at home to assist an exerciser to perform pull-up/chin-up and dip exercises as opposed to the more expensive fixed weight machines.

A disadvantage of resistance bands is that the resistance/assistance provided by the bands is variable throughout the motion of the exercise. To perform an assisted pull-up, for example, the band is secured to an overhead bar and the exerciser places a foot or knee in a loop at the lower distal end of the band. The exerciser grasps the overhead bar and his/her weight is supported by the band which is stretched as the exerciser hangs from the overhead bar with arms fully extended. At the start of the pull-up the band provides the most assistance to start the pull-up movement but very little assistance at the top of the pull-up. For example, the band may provide 125 lbs. of force at the start of the pull-up but only 50 lbs. or less at the top of the pull-up. While the exerciser may find it easy to start the pull-up, it becomes progressively more difficult as the assistance provided by the band decreases toward the top of the pull-up.

It is therefore an object of the invention described herein to provide an exercise assist apparatus where the assistance provided by progressive resistance bands is substantially linear through the exercise motion.

SUMMARY

An exercise assist apparatus may include a frame and a cam assembly pivotally connected to the frame. A cable having one end fixedly secured to the frame may extend over a traveling pulley operably connected to the cam assembly and about a fixed pulley connected to the frame. One or more progressive resistance bands may provide substantially linear exercise assistance/resistance throughout an exercise.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
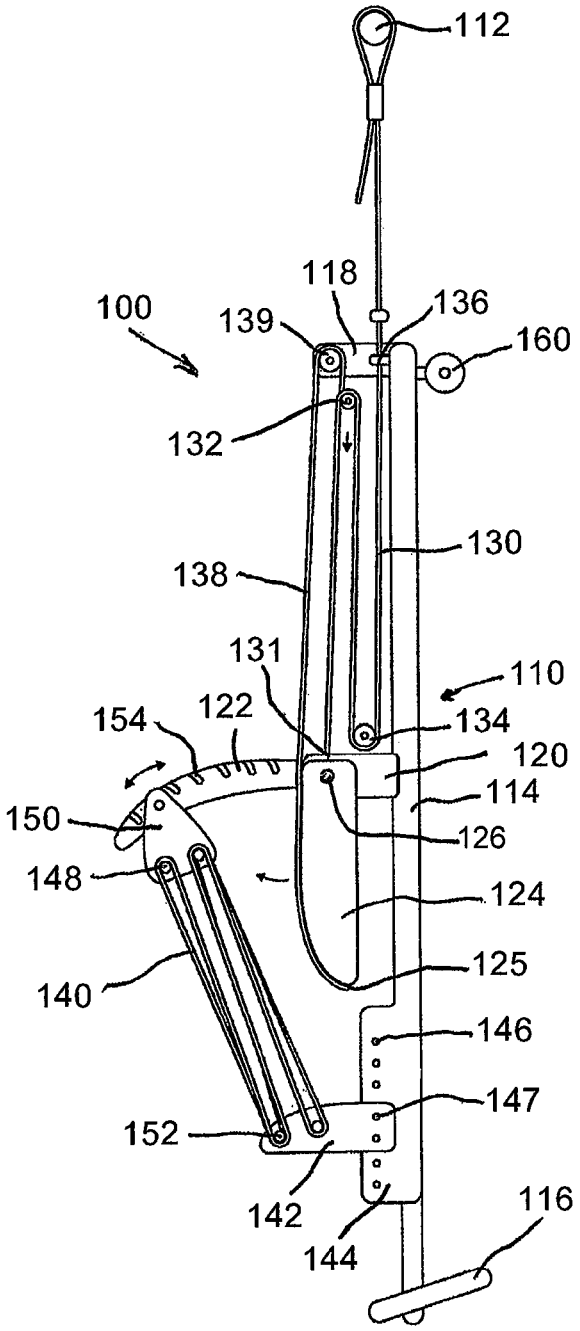
FIG. 1 is a side view of an exercise assist apparatus.

Referring first to FIG. 1, an exercise assist apparatus, for example but without limitation, a pull-up/chin-up and dip exercise assist apparatus, is generally identified by reference numeral 100. The exercise assist apparatus 100 may include a frame 110 that may be suspended from an overhead bar 112. The overhead bar 112 may be supported on posts and the like (not shown in the drawings) in a manner known in the art. The frame 110 may include an elongated frame member 114. Foot supports 116 may be secured proximate the lower distal end of the frame member 114 generally in a non-adjustable manner, however, in some instances, adjustment or pivoting of the foot supports 116 may be provided to permit orientation changes of the user's feet.

A cantilevered beam 118 may be fixedly secured proximate the upper distal end of the frame member 114. The beam 118 may extend generally horizontally from the frame member 114 perpendicular to the longitudinal axis of the frame member 114. A post 120 may project from proximate a mid-portion of the frame member 114. The post 120 may be integrally formed with the frame member 114 or otherwise fixedly secured to the frame member 114. The post 120 may be substantially parallel and spaced from the beam 118.

Referring still to FIG. 1, a cam assembly may include a lever arm 122 fixedly secured to a cam 124 at right angle to one another. The cam assembly may be pivotally connected to the post 120 at pivot pin 126. The post 120 may include a clevis end adapted to receive the pivot pin 126 therethrough for pivotally coupling the cam assembly to the post 120.

A cable 130 having a distal end fixed to the post 120 at a connection point 131 may be routed over a traveling pulley 132 and a fixed pulley 134. The pulley 134 may be fixedly secured to the post 120. The opposite end of the cable 130 may extend through an eyelet 136 and the like proximate the upper distal end of the frame member 114 The opposite distal end of the cable 130 may be removably secured to the overhead bar 112.

A cam strap 138 may have one end fixedly secured to the cam 124 at a connection point 125. The cam strap 138 may be routed over a pulley 139 fixed to the beam 118 and connected to the traveling pulley 132. It will be recognized by those skilled in the art that the cable 130 and cam strap 138 may comprise a rope, chord, chain and the like.

One or more exercise resistance bands 140 may link the lever arm 122 to an anchor arm 142. The anchor arm 142 may be movably connected to the frame member 114. The anchor arm 142 may be adjustable up and down along a lower region of the frame member 114. A flange or flanges 144 along the lower region of the frame member 114 may include through holes 146 for alignment with holes 147 in the anchor arm 142 for receipt of a removable lock pin for selectively positioning the anchor arm 142 along the lower region of the frame member 114.

The exercise resistance bands 140 may be stretched between studs 148 and the like fixed to a coupler 150 movably connected to the beam 122 and studs 152 fixed to the anchor arm 142. Single or multiple bands 140 may be employed to provide exercise resistance/assistance. Combinations of bands 140 having different tensile strengths may also be used to achieve a desired level of exercise resistance/assistance.

The lever arm 122 may include a plurality of notches 154 spaced along the length thereof. The position of the coupler 150 from the fulcrum point defined by the pivot pin 126 may be adjusted by moving the coupler 150 from one notch 154 to another closer or further away from the fulcrum point. The position of the coupler 150 from the fulcrum point may change the resistance/assistance of the bands 140 at the beginning and end of a pull-up/chin-up or dip.

The exercise assist apparatus 100 may be used by first attaching the free end of the cable 130 to the overhead bar 112. The user may then grab the overhead bar 112 and step on the foot supports 116. The weight of the user moves the frame 110 downward relative to the cable 130 which pulls the traveling pulley 132 downward and thereby apply a pulling force to the cam strap 138 and rotating the lever arm 122 and cam 134 upwardly about the pivot pin 126. The upward rotation of the lever arm 122 stretches the bands 140. As the user begins a pull-up, the bands 140 provide lifting assistance aiding the user to complete the pull-up. A body pad 160 rotatably secured to the frame member 114 may provide support against the body of the user as the pull-up is performed. It may be observed that the traveling pulley 132 yields 2 to 1 relative to the frame 110. That is, for one inch of downward movement of the frame 110, the traveling pulley 132 moves two inches downward. As noted above, the resistance of the bands 140 is non-linear, however, the cam 124 transforms the non-linear resistance to linear resistance so the uplifting assistance of the bands 140 to the user is substantially constant from the beginning to the end of the pull-up.

Figure 2:
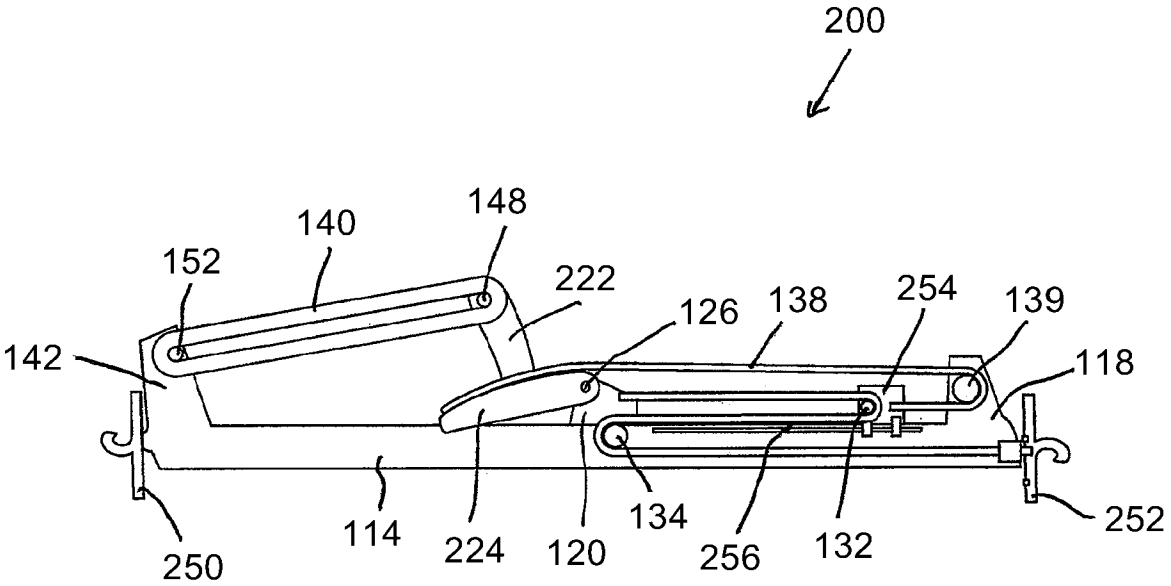
FIG. 2 is a side view of a second embodiment of an exercise assist apparatus.
Figure 3:
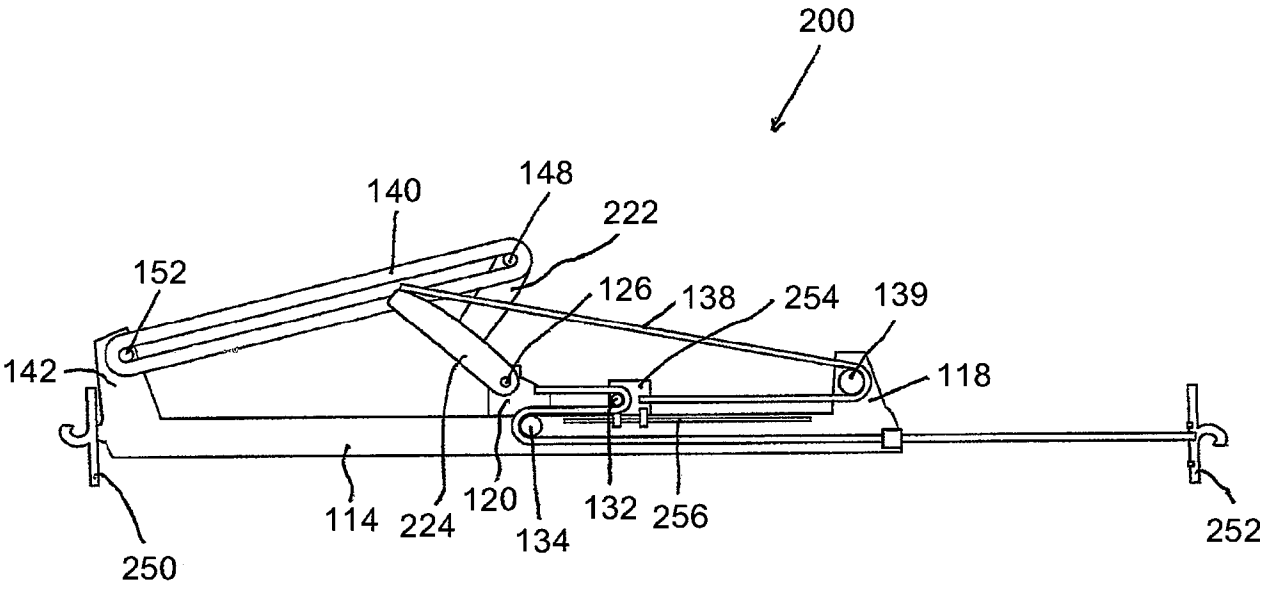
FIG. 3 is a side view illustrating the exercise assist apparatus shown in FIG. 2 in use.

Referring now to FIGS. 2 and 3, a second embodiment of an exercise assist apparatus is generally identified by reference numeral 200. As indicated by the use of common reference numerals, the exercise assist apparatus 200 is similar to the exercise assist apparatus 100 described above, with the exception that the exercise assist apparatus 200 may include combination handle and hook assemblies 250 and 252 at respective ends of the frame member 114 so that either end of the exercise assist apparatus 200 may be stationary or pulled. The handle and hook assembly 250 may be fixedly secured to a distal end of the frame member 114 and the handle and hook assembly 252 may be connected to the end of the cable 130. The travelling pulley 132 may be mounted on a traveling block 254 which in turn may move along a guide member(s) 256. A cam assembly may include a lever arm 222 fixedly secured to a cam 224 at right angle to one another. The cam assembly may be pivotally connected to the post 120 at pivot pin 126.

The exercise assist apparatus 200 may be used to perform various exercises by taking advantage of the elastic potential energy stored by stretching the bands 140. For example, but without limitation, the exercise assist apparatus 200 may be used to perform pulldown exercises, such as sitting and/or standing lateral pulldown (lat pulldown) exercises. The exercise assist apparatus 200 may be oriented generally horizontally to perform a rowing motion and the like. The exercise assist apparatus 200 may provide consistent resistance/assistance to exercise various muscle groups where the non-linear progressive resistance of the bands 140 may be transformed to substantially linear resistance.

While preferred embodiments of the invention have been shown and described, other and further embodiments of the invention may be devised without departing from the basic scope thereof, and the scope thereof is determined by the claims which follow.

The invention claimed is:

1. An exercise assist apparatus comprising:

a) a frame suspended from a support structure by a cable having one end fixedly secured to said frame and an opposite end connected to the support structure, wherein said frame is movable along said cable;

b) a cam assembly pivotally connected to said frame;

c) an anchor arm secured proximate to a lower region of said frame; and d) one or more resistance bands interconnecting said cam assembly and said anchor arm.

2. The exercise assist apparatus of claim 1 further including a traveling pulley suspended from said frame, said cable routed over said traveling pulley.

3. The exercise assist apparatus of claim 2 wherein said cam assembly includes a lever arm fixedly connected to a cam pivotally connected to said frame, and further including a cam strap connecting said cam and said traveling pulley.

4. The exercise assist apparatus of claim 3 wherein said cam assembly point of connection to said frame defines a fulcrum point, and wherein said lever arm includes a plurality of notches spaced apart from one another for adjusting the distance of the connection point of said one or more resistance bands from said fulcrum point.

5. The exercise assist apparatus of claim 1 further including a first handle and hook connected to said cable and a second handle and hook fixedly secured to a distal end of said frame.

6. The exercise assist apparatus of claim 5 further including a traveling pulley rotatably secured to a traveling block constrained to travel along a guide member fixed to said frame.

7. The exercise assist apparatus of claim 1 further including a first pulley and a second pulley spaced apart from one another fixedly secured to said frame.

8. The exercise assist apparatus of claim 1 wherein said anchor arm is movably connected to said frame.

9. An exercise assist apparatus comprising:

a) a frame suspended from a support structure;

b) a cable securing said frame to the support structure;

c) a traveling pulley movably connected to said frame, said cable routed over said traveling pulley;

d) a cam pivotally connected to said frame, a cam strap connecting said cam and said traveling pulley; and e) one or more exercise resistance bands interconnecting said cam and said frame.

10. The exercise assist apparatus of claim 9 further including a traveling block constrained to travel along a guide member fixed to said frame, said traveling pulley rotatably secured to said traveling block.

11. The exercise assist apparatus of claim 10 further including a lever arm fixedly secured to said cam interconnecting said one or more exercise resistance bands with said cam.

12. The exercise apparatus of claim 11 wherein said cam point of connection to said frame defines a fulcrum point, and wherein said lever arm includes a plurality of notches spaced apart from one another for adjusting the distance of the connection point of said one or more resistance bands from said fulcrum point.

13. The exercise assist apparatus of claim 9 further including a first pulley and a second pulley spaced apart from one another fixedly secured to said frame, said cable routed over said first pulley and said second pulley.

14. An exercise assist apparatus comprising:

a) a frame suspended by a cable connected to a support structure, said frame being movable along said cable;

b) a cam assembly pivotally connected to said frame;

c) a traveling pulley movably connected to said frame, said cable routed over said traveling pulley; and d) a plurality of resistance bands interconnecting said cam assembly with said frame.

* * * * *